US011642677B2

(12) United States Patent
Lodge et al.

(10) Patent No.: US 11,642,677 B2
(45) Date of Patent: May 9, 2023

(54) SPLIT MICROPLATE AND VIALS

(71) Applicant: QIS, Inc., Rosenhayn, NJ (US)

(72) Inventors: Daniel A. Lodge, Rosenhayn, NJ (US); David G. Concordia, Vineland, NJ (US)

(73) Assignee: QIS, Inc., Rosenhayn, NJ (US)

( * ) Notice: Subject to any disclaimer, the term of this patent is extended or adjusted under 35 U.S.C. 154(b) by 537 days.

(21) Appl. No.: 16/704,001

(22) Filed: Dec. 5, 2019

(65) Prior Publication Data

US 2021/0170416 A1 Jun. 10, 2021

(51) Int. Cl.
*B01L 9/06* (2006.01)

(52) U.S. Cl.
CPC ..... *B01L 9/06* (2013.01); *B01L 2300/0809* (2013.01); *B01L 2300/0832* (2013.01); *B01L 2300/0851* (2013.01)

(58) Field of Classification Search
CPC .... B65D 75/327; B65D 75/367; B65D 83/04; B65D 83/0445; B65D 83/06
USPC ..... 206/538, 557, 563, 504, 528, 561; 203/538, 557, 563, 504, 528, 561
See application file for complete search history.

(56) References Cited

U.S. PATENT DOCUMENTS 6,106,783 A * 8/2000 Gamble ..... B01L 3/50825 422/553
6,132,684 A 10/2000 Marino
6,568,544 B1 5/2003 Lafond et al.
8,182,763 B2 5/2012 Duffy et al.
2001/0002986 A1* 6/2001 Fattinger ..... B01L 9/06 422/562
2007/0059219 A1* 3/2007 Turner ..... B29C 45/561 422/400
2007/0116613 A1* 5/2007 Elsener ..... B01L 3/50255 422/400
2010/0119417 A1* 5/2010 Motadel ..... B01L 3/00 264/320

(Continued)

FOREIGN PATENT DOCUMENTS

AU 2011343192 A1 * 7/2013 ..... C12M 25/14

*Primary Examiner* — Edwyn Labaze
(74) *Attorney, Agent, or Firm* — Norman E. Lehrer

(57) ABSTRACT

A split or two-part microplate is formed of a base and a rack. The rack has a top with a plurality of openings capable of holding glass vials. The base has an interior bottom surface and an exterior bottom surface and a plurality of upwardly extending vertical walls and being so dimensioned and sized so as to fit onto the base with at least a portion of the top planar surface resting on the vertical walls. When the rack is assembled onto the base, the top planar surface is spaced from the bottom surface by a first distance. The rack includes downwardly extending legs that are adapted to rest on a flat surface whereby the top planar surface is spaced from the flat surface by a second distance which is greater than the first distance. A plurality of vials is held in the openings and include rims preventing the vials from passing through the openings. The length of the vials from below the rim to the bottom is greater than the first distance but less than the second distance. Whereby, when the rack is resting on a flat surface, the vials hang from the rack and when the rack is assembled onto the base, the bottoms of the vials engage the interior bottom surface and the rims of the vials are positioned above the top planar surface.

4 Claims, 3 Drawing Sheets

(56) References Cited

U.S. PATENT DOCUMENTS

| | | | | |
|---|---|---|---|---|
| 2010/0140173 | A1 | 6/2010 | Suh et al. | |
| 2013/0309147 | A1* | 11/2013 | Yu | B01L 3/50853 422/550 |
| 2013/0330253 | A1 | 12/2013 | Decabooter et al. | |
| 2021/0291169 | A1* | 9/2021 | Laugharn, Jr. | B01L 3/50853 |

* cited by examiner

SPLIT MICROPLATE AND VIALS

BACKGROUND OF THE INVENTION

The present invention is directed toward the combination of a plurality of vials and a microplate and, more particularly, toward the combination of vials and a microplate wherein the microplate is split into two separate parts.

As is well known in the art, microplates are widely used for storing, filtering, incubating and detecting samples in chemical experiments, biological assays, medical tests and the like. For example, a microplate might be used as micro-containers to store, filter, prepare, or incubate multiplicate samples in different wells. A microplate can also be used to conduct relatively tiny volume cell cultures in vitro. The sample filled microplate might eventually be subject to specific measuring methods to analyze its contents qualitatively and/or quantitatively in chromatographic or spectrometry systems.

Some microplates, and primarily those made of plastic, have the wells formed directly therein. Others include openings in the top thereof into which can be inserted a plurality of glass or plastic vials. While microplates may come in various sizes, the current standard and most widely used today is one that has 96 wells or, as with the present invention, includes openings that can hold 96 vials. In the preferred embodiment of the present invention, the inventive microplate, made of plastic, is designed to hold 96 glass vials.

As is also well known in the art, many vials used with microplates are often manipulated robotically. This requires that the vials be arranged in the microplate so that they can by grasped and lifted by a robotic arm or gripper. Not only must they be exposed so that they can be gripped, they must be kept in an essentially vertical position. Even further, in many applications, a needle extends down onto a vial from the top and there must be a way to determine whether the needle has extended downwardly a sufficient distance. To Applicants' knowledge, there is no microplate available that satisfies all of the desired requirements.

A need exists, therefore, for a microplate and vial combination that maintains the vials in a substantially vertical orientation but which exposes the tops of the vials so that they can be gripped robotically and which provides means for controlling the depth of a needle moving downwardly into the vial.

SUMMARY OF THE INVENTION

The present invention is designed to overcome the deficiencies of the prior art discussed above. It is an object of the present invention to provide a microplate and vial combination wherein the microplate is split into two parts for easier handling.

It is another object of the present invention to provide such a microplate and vial combination that maintains the vials in a slightly raised position so that they are accessible for robotic access.

It is a still further object of the present invention to provide such a microplate and vial combination that maintains the vials in a substantially vertical position even when the vials are raised.

In accordance with the illustrative embodiments demonstrating features and advantages of the present invention, there is provided a split or two-part microplate that is formed of a base and a rack. The rack has a top with a plurality of openings capable of holding glass vials. The base has an interior bottom surface and an exterior bottom surface and a plurality of upwardly extending vertical walls and being so dimensioned and sized so as to fit onto the base with at least a portion of the top planar surface resting on the vertical walls. When the rack is assembled onto the base, the top planar surface is spaced from the bottom surface by a first distance. The rack includes downwardly extending legs that are adapted to rest on a flat surface whereby the top planar surface is spaced from the flat surface by a second distance which is greater than the first distance.

A plurality of vials are held in the openings and include rims preventing the vials from passing through the openings. The length of the vials from below the rim to the bottom is greater than the first distance but less than the second distance, whereby, when the rack is resting on a flat surface, the vials hang from the rack and when the rack is assembled onto the base, the bottoms of the vials engage the interior bottom surface and the rims of the vials are positioned above the top planar surface.

The interior bottom surface of the base includes a plurality of recesses which includes a low point and slanted walls leading into the low point, the slanted walls guiding the bottom end of said vial into the low point. In addition, the exterior bottom surface of the base includes flat surfaces formed directly beneath the recesses.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 4:
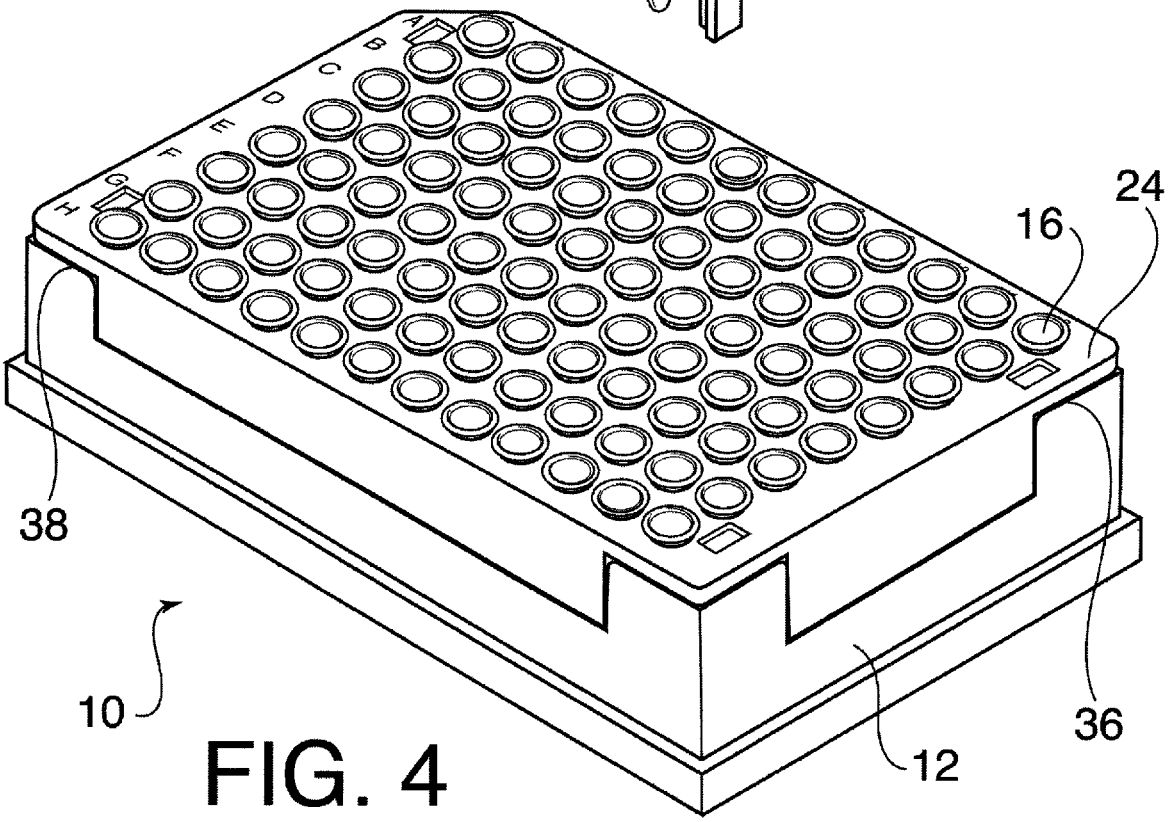
FIG. 4 is a front top perspective view of the combined split microplate filled with vials.

Referring now to the drawings in detail wherein like reference numerals have been used throughout the various figures to designate like elements, there is shown in FIG. 4 a split microplate and vials constructed in accordance with the principles of the present invention and designated generally as 10.

The split microplate and vials 10 is comprised essentially of two parts, the microplate 12 and the plurality of vials such as shown at 14, 16 and 18. The microplate itself is also comprised of two parts: a base 20 as shown best in FIG. 2 and a rack 22 as best shown in FIG. 1.

The rack 22 has a top planar surface 24 with a plurality of openings 26 therein. In the preferred embodiment of the invention, there are 96 such openings 26. This is, however, only the preferred embodiment of the invention as a different number of openings 26 may be provided depending on the equipment in which the microplate is intended to be used.

The base 20 includes an interior bottom surface 28 and an exterior bottom surface 30. See FIG. 5. The base also includes a plurality of upwardly extending vertical walls such as shown at 32 and 34 around the periphery of the bottom surfaces 28 and 30. The rack 22 is dimensioned and sized so as to fit onto the base 20 with at least a portion of the top planar surface 24 resting on the tops 36 and 38 of the vertical walls 32 and 34 when the rack 22 is assembled onto the base 20. As shown most clearly in FIG. 5, the top planar surface 24 is spaced from the interior bottom surface 28 when the rack 22 is assembled onto the base 20 by a first distance.

Figure 1:
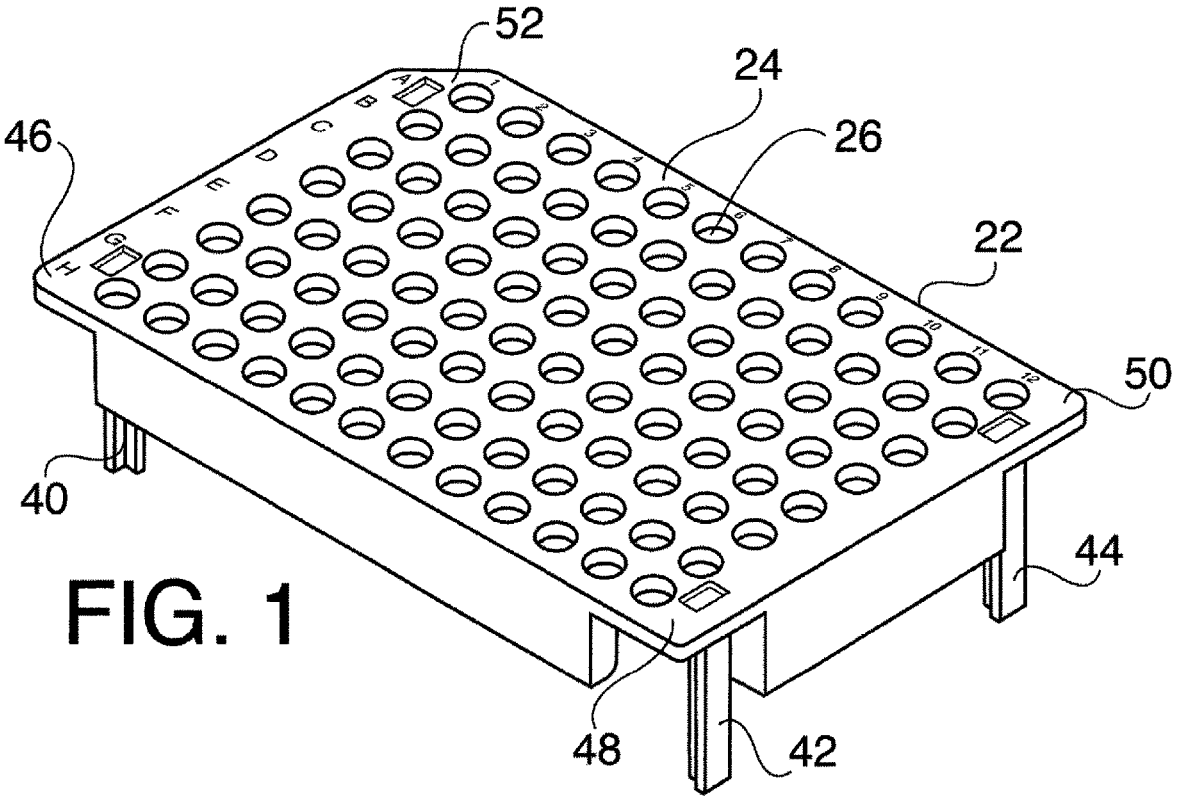
FIG. 1 is a front top perspective view of the rack portion of the split microplate of our invention without any vials being held therein.
Figure 2:
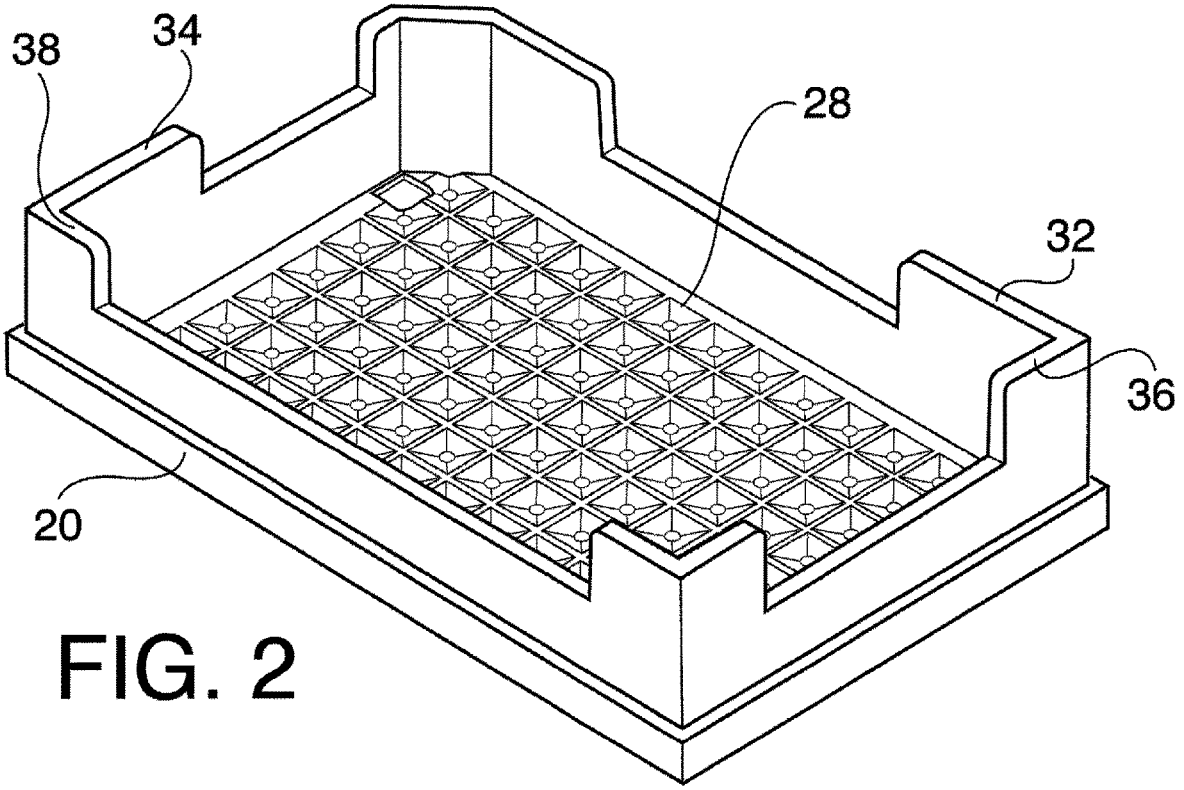
FIG. 2 is a front top perspective view of the base portion of the split microplate of our invention.

The rack 22 also includes four downwardly extending legs 40, 42 and 44 as shown in FIG. 1. The fourth leg is not specifically shown in the figures but it will be understood that it is substantially the same as the three legs that are shown. These legs extend downwardly from each of the corners 46, 48, 50 and 52 of the top planar surface 24.

The legs are all of the same length and are adapted to rest on a flat support surface such as a tabletop or the like whereby the top planar surface 24 will be spaced from the flat support surface by a second distance. This second distance is essentially the same as the height of each of the legs but is greater than the first distance described above.

Figure 3:
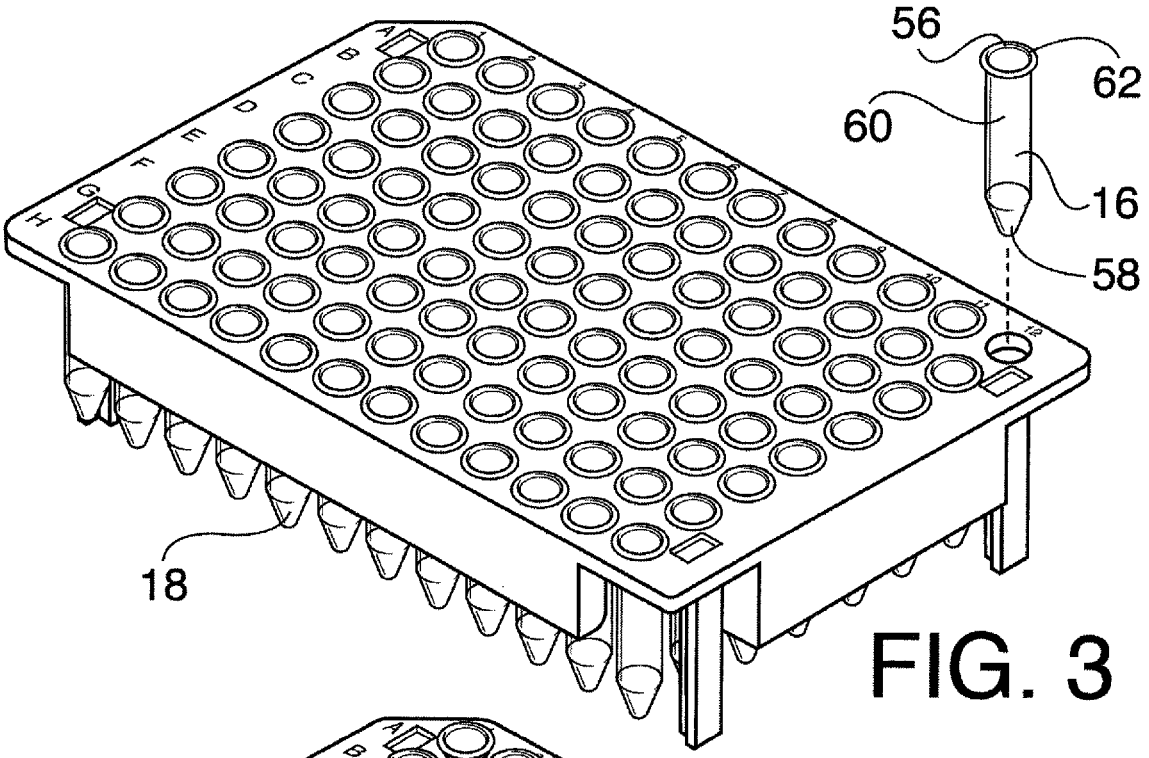
FIG. 3 is view similar to FIG. 1 but showing the rack portion filled with vials.

Each of the vials such as vial 16 shown in FIG. 3 has an open top end 56, a closed bottom end 58 and a substantially cylindrically shaped body 60. The diameter of the cylindrical body 60 is slightly less than the diameter of the openings 26 in the top planar surface 24 of the rack 22. This, of course, allows the vials to enter the openings.

Each of the vials also includes an outwardly extending rim 62 adjacent the top end 56 thereof. The rim 62 is wider than the diameter of the openings 26 in the top planar surface 24 thereby preventing the vials from passing downwardly through the openings. It is understood that while only one or two vials are shown in detail, each of the vials in the rack are constructed in essentially the same manner.

The length of the vials such as vial 16 from below the rim 62 to the bottom end 58 thereof is greater than the first distance described above but less than the second distance. As a result, when the rack 22 is resting on a flat or support surface through the use of the legs 40, 42 and 44, the vials hang from the rack by the rims 62. However, when the rack 22 is assembled onto the base 20, the bottoms 58 of the vials engage the interior bottom surface 28 and the rims 62 of the vials are positioned above the top planar surface 24 of the rack 22. This is shown most clearly in FIG. 5.

Figure 5:
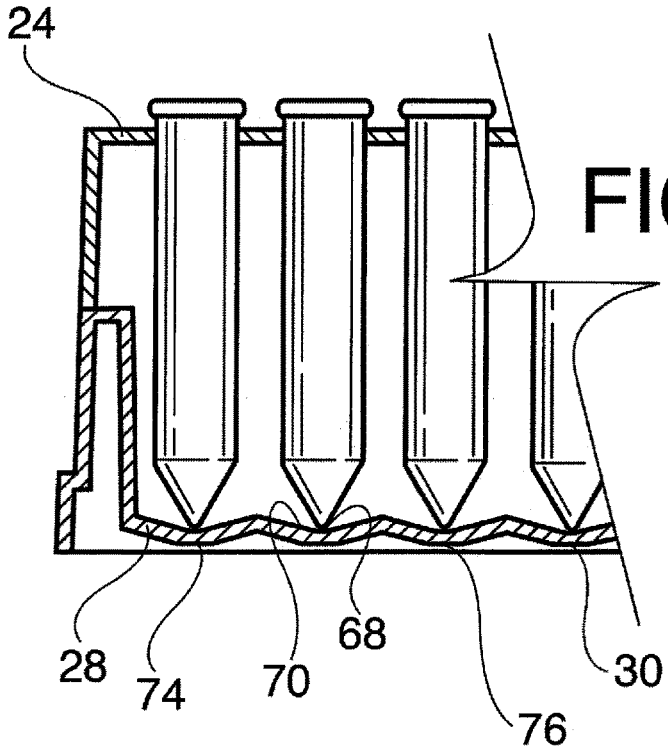
FIG. 5 is a cross-sectional view of a portion of FIG. 4.
Figure 6:
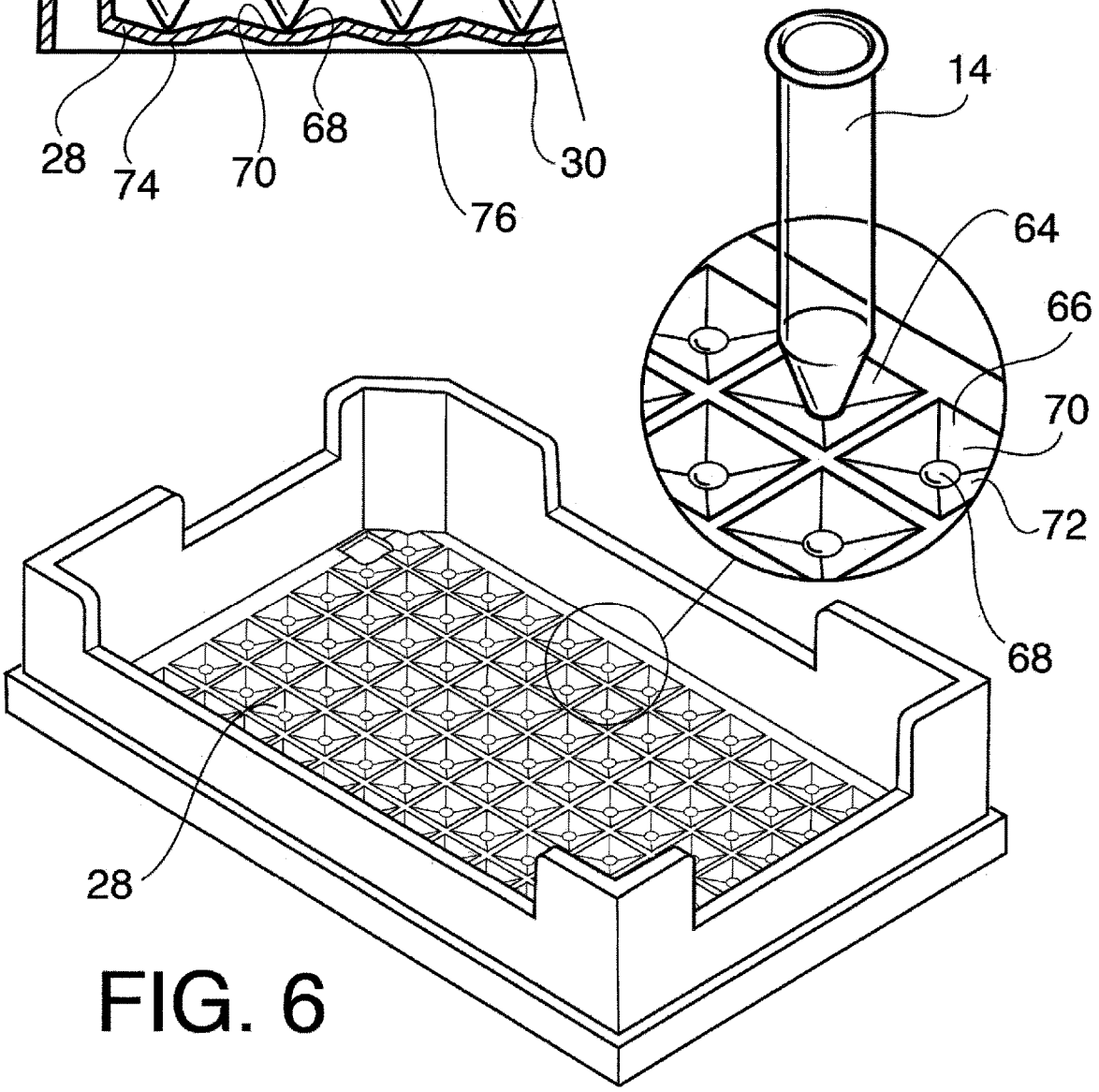
FIG. 6 is a front top perspective view similar to FIG. 2 but showing a portion thereof exploded.

As is also shown most clearly in FIGS. 5 and 6, the interior bottom surface 28 of the base 20 includes a plurality of recesses such as shown at 64 and 66. Each recess is associated with a different opening 26 and lies directly beneath the same when the rack 22 is assembled onto the base 20. Each of the recesses 64 and 66 includes a low point 68 and slanted walls such as shown at 70 and 72 leading to the low point 68. As a result of this arrangement, the slanted walls 70 and 72 guide the bottom end 58 of each of the vials into the low point 68 as the rack 22 with the vials loaded thereon is assembled onto the base 20. This helps to maintain each of the vials in a substantially vertical position.

As can best be seen in FIG. 5, the exterior bottom surface 30 of the base 20 includes flat surfaces 74 and 76 that are formed directly beneath each of the low points 68 of the recesses. This allows the base 20 to be placed on a metal plate or the like of an apparatus which is then capable of measuring the quantity of a liquid within each vial or which can determine the depth of a needle passing downwardly into a vial.

The present invention may be embodied in other specific forms without departing from the spirit or essential attributes thereof and accordingly, reference should be made to the appended claims rather than to the foregoing specification as indicating the scope of the invention.

We claim:

1. A split microplate and vials comprising:

a split microplate including a base and a rack, said rack having a top planar surface including a plurality of openings therein, said base having an interior bottom surface and an exterior bottom surface and a plurality of upwardly extending vertical walls around the periphery of said bottom surfaces, said rack being so dimensioned and sized so as to fit onto said base with at least a portion of said top planar surface resting on the tops of said vertical walls when said rack is assembled onto said base, said top planar surface is spaced from said interior bottom surface by a first distance;

said rack further including four corners and including a downwardly extending leg at each corner, said legs being adapted to rest on a flat surface whereby said top planar surface will be spaced from said flat surface by a second distance, said second distance being greater than said first distance;

a plurality of vials, each of said vials having an open top end and a closed bottom end and a substantially cylindrically shaped body between said top and bottom ends, the diameter of said cylindrical body being slightly less than the diameter of said openings in said top planar surface of said rack, each of said vials including a rim adjacent said top end, said rim being wider than the diameter of said openings in said top planar surface of said rack thereby preventing said vials from passing downwardly through said openings, the length of said vials from below said rim to the bottom end being greater than said first distance but less than said second distance, and whereby when said rack is resting on a flat surface, said vials hang from said rack by said rims and when said rack is assembled onto said base, said bottoms of said vials engage said interior bottom surface and said rims of said vials are positioned above said top planar surface.

2. The split microplate and vials as claimed in claim 1 wherein said interior bottom surface of said base includes a plurality of recesses therein, each recess being associated with a different opening in said rack and lying directly beneath the same when said rack is assembled onto said base.

3. The split microplate and vials as claimed in claim 2 wherein each of said recesses includes a low point and slanted walls leading into said low point, said slanted walls guiding the bottom end of said vial into said low point.

4. The split microplate and vials as claimed in claim 3 wherein said exterior bottom surface of said base includes flat surfaces formed directly beneath said recesses.

* * * * *